US008786271B2

(12) United States Patent
Chang et al.

(10) Patent No.: US 8,786,271 B2
(45) Date of Patent: Jul. 22, 2014

(54) CIRCUIT AND METHOD FOR GENERATING REFERENCE VOLTAGE AND REFERENCE CURRENT

(75) Inventors: Tsung-Hau Chang, Tainan (TW); Yung-Chou Lin, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 628 days.

(21) Appl. No.: 13/089,931

(22) Filed: Apr. 19, 2011

(65) Prior Publication Data

US 2012/0068685 A1 Mar. 22, 2012

(30) Foreign Application Priority Data

Sep. 21, 2010 (TW) ..... 99132102 A

(51) Int. Cl.

| | |
|---|---|
| ***G05F 3/16*** | (2006.01) |
| ***G05F 3/20*** | (2006.01) |
| ***G05F 1/10*** | (2006.01) |
| ***G05F 3/02*** | (2006.01) |

(52) U.S. Cl.
USPC ..... 323/313; 327/538

(58) Field of Classification Search
USPC ..... 323/313; 327/538
See application file for complete search history.

(56) References Cited

U.S. PATENT DOCUMENTS

| | | | | |
|---|---|---|---|---|
| 4,990,846 | A * | 2/1991 | Buck et al. | 323/314 |
| 5,528,128 | A * | 6/1996 | Melse | 323/313 |
| 6,815,941 | B2 * | 11/2004 | Butler | 323/313 |
| 7,456,678 | B2 * | 11/2008 | Passerini et al. | 327/538 |

FOREIGN PATENT DOCUMENTS

TW 200827978 A 7/2008

* cited by examiner

*Primary Examiner* — Jue Zhang
(74) *Attorney, Agent, or Firm* — Rabin & Berdo, P.C.

(57) ABSTRACT

A circuit for generating reference voltage and reference current includes a band-gap reference circuit and a voltage-to-current converting circuit. The band-gap reference circuit is configured to generate a temperature-independent reference voltage by generating a first current with a positive temperature coefficient. The voltage-to-current converting circuit is coupled to a node of the band-gap reference circuit and configured to convert a voltage with a negative temperature coefficient at the node into a second current with a negative temperature coefficient. The band-gap reference circuit and the voltage-to-current converting circuit share a common current source having a feedback transistor through which a reference current flows. The reference current is divided into the first current of the band-gap reference circuit and the second current of the voltage-to-current converting circuit, thus having a temperature coefficient substantially equal to zero by combining the first current and the second current.

10 Claims, 2 Drawing Sheets

CIRCUIT AND METHOD FOR GENERATING REFERENCE VOLTAGE AND REFERENCE CURRENT

This application claims the benefit of Taiwan application Serial No. 99132102, filed Sep. 21, 2010, the subject matter of which is incorporated herein by reference.

BACKGROUND OF THE INVENTION

1. Field of the Invention

The invention relates in general to a circuit and method for generating reference voltage and reference current, and more particularly to a circuit and method for generating temperature-independent reference voltage and reference current.

2. Description of the Related Art

Temperature-independent reference voltage and/or temperature-independent reference current are often applied in design of integrated circuits, which are normally generated by band-gap reference circuits.

For example, in order to generate a temperature-independent reference voltage (i.e. having a zero temperature coefficient), a bipolar transistor featuring a negative temperature coefficient is usually used to generate a voltage with a negative temperature coefficient, and a resistor featuring a conversion ability is used to convert a current with a positive temperature coefficient into a voltage with a positive temperature coefficient. Finally, the negative-temperature-coefficient voltage and the positive-temperature-coefficient voltage are summed by weight to obtain the zero-temperature-coefficient reference voltage. On the other hand, in order to generate a temperature-independent reference current, a bipolar transistor featuring a negative temperature coefficient and a resistor featuring a conversion ability are used to generate a negative-temperature-coefficient current. And finally, the negative-temperature-coefficient current is summed by weight with a positive-temperature-coefficient current to obtain a zero-temperature-coefficient current.

In practical applications, it is common to use at the same time both the temperature-independent reference voltage and the temperature-independent reference current. In such cases, for example, it can be designed to generate the temperature-independent reference voltage by using a band-gap reference circuit and generate the temperature-independent reference current by using another band-gap reference circuit. Alternatively, it can be designed to first generate a reference current (or reference voltage) with a zero temperature coefficient, and then use an extra circuit to mirror and convert the zero-temperature-coefficient reference current (or reference voltage) into a zero-temperature-coefficient reference voltage (or reference current). The extra circuit normally has a bias current source for duplicating a current (or a voltage) and at least a resistor for converting a current into a voltage (or converting a voltage into a current).

However, the conventional circuit usually requires a large number of devices, thus occupying a large chip area and taking large power consumption and production costs. One of the reasons is that, in conception of circuit design, the generation of reference voltage and the generation of reference current are not integrated. Consequently, it has become one of industrial endeavors in search and development to design a simple circuit which can simultaneously generate zero-temperature-coefficient reference voltage and reference current.

SUMMARY OF THE INVENTION

The disclosure is directed to a circuit and method for generating reference voltage and reference current. The circuit includes a band-gap reference circuit for providing a temperature-independent reference voltage and a voltage-to-current converting circuit sharing a common current source with the band-gap reference circuit. Accordingly, a temperature-independent reference current can be generated on the common current source. Compared to the prior-art technology, the reference voltage and reference current generating circuit can effectively simplify circuit structure, reduce circuit area and power consumption and lower down production costs. Further, the disclosure also provides a reference voltage and reference current generating method.

According to a first aspect, a circuit for generating reference voltage and reference current is provided. The circuit includes a band-gap reference circuit and a voltage-to-current converting circuit. The band-gap reference circuit is configured to generate a temperature-independent reference voltage by generating a first current with a positive temperature coefficient. The voltage-to-current converting circuit, coupled to a node of the band-gap reference circuit, is configured to convert a voltage with a negative temperature coefficient at the node into a second current with a negative temperature coefficient. The band-gap reference circuit and the voltage-to-current converting circuit share a common current source, which has a feedback transistor through which a reference current flows. The reference current is divided into the first current of the band-gap reference circuit and the second current of the voltage-to-current converting circuit, thus having a temperature coefficient substantially equal to zero by combining the first current and the second current.

According to a second aspect, a circuit for generating reference voltage and reference current is provided. The circuit includes a band-gap reference circuit and a voltage-to-current converting circuit. The band-gap reference circuit is configured, by generating a first current with a positive temperature coefficient flowing through a first node of the bank-gap reference circuit, to generate a temperature-independent reference voltage to be outputted at the first node. The voltage-to-current converting circuit is coupled to a second node of the band-gap reference circuit and configured to convert a voltage with a negative temperature coefficient at the second node into a second current with a negative temperature coefficient flowing through the first node. The band-gap reference circuit and the voltage-to-current converting circuit share a common current source coupled to the first node for outputting a reference current. The reference current is divided into the first current of the band-gap reference circuit and the second current of the voltage-to-current converting circuit at the first node, thus having a temperature coefficient substantially equal to zero by combining the first current and the second current.

According to a third aspect, a circuit for generating reference voltage and reference current is provided. The circuit includes a band-gap reference circuit and a voltage-to-current converting circuit. The band-gap reference circuit, configured to output a temperature-independent reference voltage, includes a proportional-to-absolute-temperature (PTAT) current generating part and a first operational amplifier. The PTAT current generating part includes a first junction transistor, a second junction transistor, a first resistor device, a second resistor device and a third resistor device. The first junction transistor and the second junction transistor are coupled to each other. The first resistor device, the second resistor device and the third resistor device are respectively coupled between the second junction transistor and the second resistor device, between the first resistor device and a first node, and between the first junction transistor and the first node. The first operational amplifier has a first input terminal coupled between the first resistor device and the second resistor device, a second input terminal coupled between the third resistor device and the first junction transistor, and an output terminal. The voltage-to-current converting circuit includes a second operational amplifier and a bias current source. The second operational amplifier has a first input terminal coupled between the first junction transistor and the third resistor device, a second input terminal and an output terminal. The bias current source includes a bias transistor. The bias transistor has a first terminal coupled to the output terminal of the second operational amplifier, a second terminal coupled to the first node and a third terminal. The fourth resistor device has one end coupled to the third terminal of the bias transistor and the second input terminal of the second operational amplifier. The band-gap reference circuit and the voltage-to-current converting circuit share a common current source, which includes a feedback transistor coupled to a voltage source, the first node and the output terminal of the first operational amplifier for outputting a temperature-independent reference current.

According to a fourth aspect, a method for generating reference voltage and reference current is provided. The method includes generating a temperature-independent reference voltage by generating a first current with a positive temperature coefficient, and simultaneously generating a feedback bias voltage and a voltage with a negative temperature coefficient, converting the voltage with a negative temperature coefficient into a second current with a negative temperature coefficient, and generating a reference current based on the feedback bias voltage. The reference current, by combining the first current and the second current, can thus have a temperature coefficient substantially equal to zero.

The above and other aspects of the invention will become better understood with regard to the following detailed description of the preferred but non-limiting embodiment(s). The following description is made with reference to the accompanying drawings.

DETAILED DESCRIPTION OF THE INVENTION

The following embodiment is directed to a circuit for generating reference voltage and reference current, which mainly includes a band-gap reference circuit for generating a positive-temperature-coefficient current and accordingly generating a temperature-independent reference voltage, and a voltage-to-current converting circuit for converting a negative-temperature-coefficient voltage into a negative-temperature-coefficient current. Besides, the band-gap reference circuit and the voltage-to-current converting circuit share a common current source. The positive-temperature-coefficient current of the band-gap reference circuit and the negative-temperature-coefficient current of the voltage-to-current converting circuit are combined in the common current source to generate a temperature-independent reference current.

A common point in conventional circuits is that the generation of the reference voltage and reference current is not integrated in conception of circuit design and thus a number of bias current sources are required to simultaneously generate a temperature-independent reference voltage and a temperature-independent reference current. However, the reference voltage and reference current generating circuit of the invention integrates the function of generating a reference current into a band-gap reference circuit originally used to generate only a reference voltage by way of sharing a common current source. Therefore, compared to prior-art technology, the reference voltage and reference current generating circuit can greatly reduce the circuit complexity, occupying area and power consumption, and thus decease the production cost of the integrated circuit.

Figure 1:
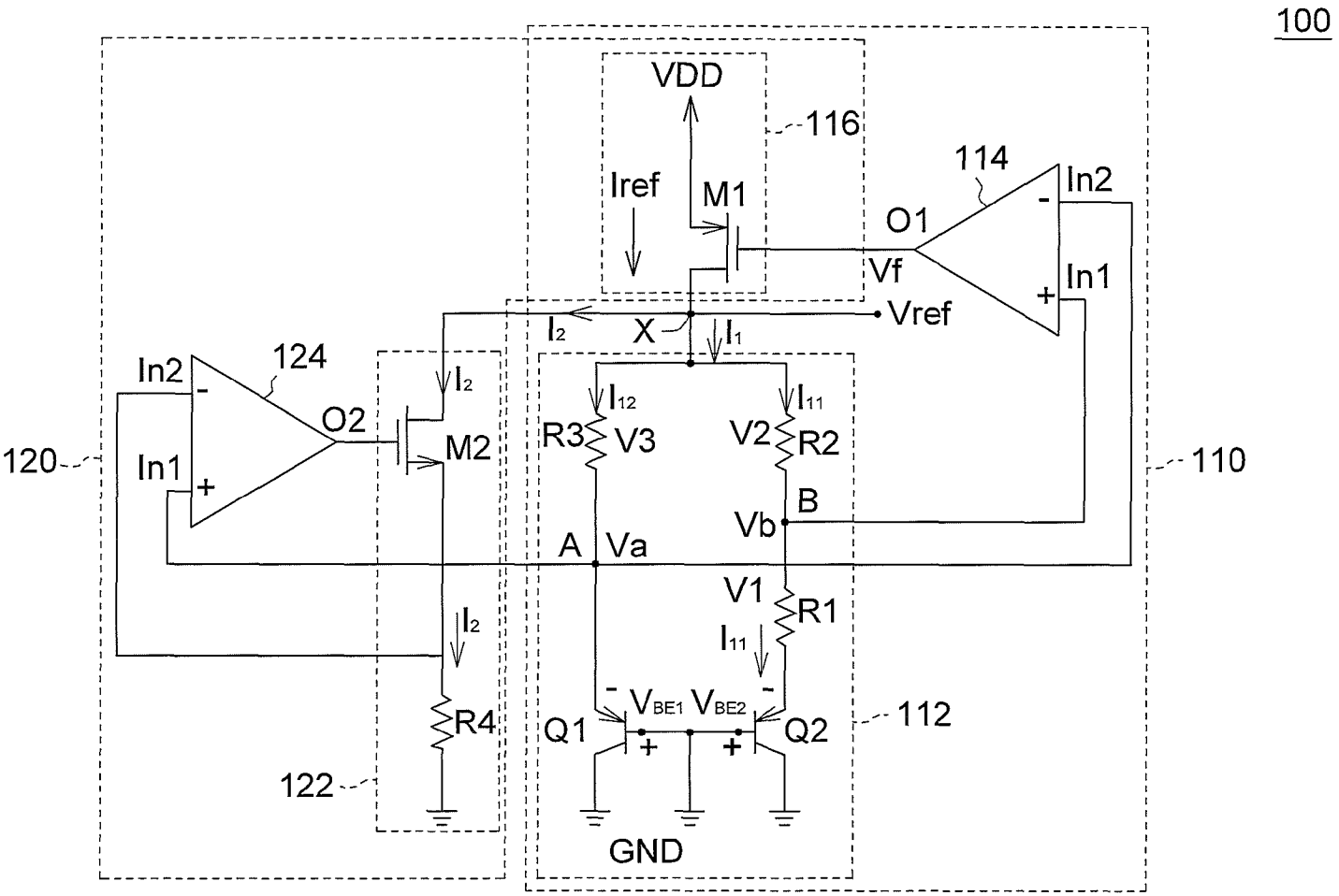
FIG. 1 is a circuit diagram of a reference voltage and reference current generating circuit according to a preferred embodiment.

Referring to FIG. 1, a circuit diagram of a reference voltage and reference current generating circuit according to a preferred embodiment is shown. As shown in FIG. 1, the reference voltage and reference current generating circuit 100 includes a band-gap reference circuit 110 and a voltage-to-current converting circuit 120, wherein the band-gap reference circuit 110 and the voltage-to-current converting circuit 120 share a common current source 116.

The band-gap reference circuit 110 is configured to generate a first current $I_1$ with a positive temperature coefficient flowing through a first node X. By generating the first current $I_1$, the band-gap reference circuit 110 can generate a zero-temperature-coefficient (i.e. temperature-independent) reference voltage Vref, which can also be outputted at the first node X.

On the other hand, the voltage-to-current converting circuit 120 is coupled to a second node A of the band-gap reference circuit 110, configured to convert the voltage Va with a negative temperature coefficient at the second node A into a second current $I_2$ with a negative temperature coefficient. Similar to the first current $I_1$, the second current $I_2$ flows through the first node X. Through suitable circuit design, the negative temperature coefficient of the second current $I_2$ can be adjusted to be equal to the positive temperature coefficient of the first current $I_1$.

The common current source 116 shared by the band-gap reference circuit 110 and the voltage-to-current converting circuit 120 is coupled to the first node X for flowing and outputting a reference current Iref. As shown in FIG. 1, at the first node X, the reference current Iref is divided into the first current $I_1$ of the band-gap reference circuit 110 and the second current $I_2$ of the voltage-to-current converting circuit 120.

Since the reference current Iref is a combination current of the first current $I_1$ and the second current $I_2$ (i.e. $Iref=I_1+I_2$), and the positive temperature coefficient of the first current $I_1$ is equal to the negative temperature coefficient of the second current $I_2$, the reference current Iref has a temperature coefficient substantially equal to zero.

According to the above discussion, due to having a simple structure to share a common current source 116, the reference voltage and reference current generating circuit 100 can simultaneously generate a zero-temperature-coefficient reference voltage Vref and a zero-temperature-coefficient reference current Iref, without need of extra circuit devices for duplication and conversion. In the following description, an embodiment is further provided to illustrate the detailed structure and operational principle of the band-gap reference circuit 110 and the voltage-to-current converting circuit 120.

FIG. 1 also shows a detailed circuit diagram of the band-gap reference circuit 110 according to the embodiment of the invention. As shown in FIG. 1, in addition to the common current source 116, the band-gap reference circuit 110 also includes a proportional-to-absolute-temperature (PTAT) current generating part 112 coupled to the common current source 116 at the first node X and includes an operational amplifier 114 coupled between the PTAT current generating part 112 and the common current source 116.

In a specific embodiment (as shown in FIG. 1), the PTAT current generating part 112 can include a first junction transistor Q1 and a second junction transistor Q2 and first to third resistor devices R1~R3. The junction transistors Q1 and Q2, such as PNP bipolar transistors, both have a collector and a base coupled to a ground voltage GND. The junction transistors Q1 and Q2 have different current area densities. For example, the area (e.g. A) of the junction transistor Q1 is smaller than the area (e.g. nA) of the junction transistor Q2, wherein n is a positive integer larger than 1. On the other hand, the first resistor device R1 is coupled between the emitter of the junction transistor Q2 and the second resistor device R2. The second resistor device R2 is coupled to the common current source 116 via the first node X and coupled to the first resistor device R1 via a node B. The third resistor device R3 is coupled to the common current source 116 via the first node X and coupled to the emitter of the junction transistor Q1 via a second node A.

The operational amplifier 114 has two input terminals In1 (e.g. positive input terminal +) and In2 (e.g. negative input terminal −), respectively coupled to the two nodes B and A of the PTAT current generating part 112. Besides, the operational amplifier 114 also has an output terminal O1 for generating a feedback bias voltage Vf supplied to the common current source 116. Through the feedback effect of the operational amplifier 114, the common current source 116 can be suitably biased to output the reference current Iref.

The common current source 116 includes a feedback transistor M1, such as a p-type metal oxide semiconductor (PMOS) transistor. The feedback transistor M1 has a drain coupled to the first node X, a gate coupled to the output terminal O1 of the operational amplifier 114 and a source coupled to a voltage source VDD.

Under the above circuit configuration, the PTAT current generating part 112 can cooperate with the operational amplifier 114 and the common current source 116 to generate two branch currents $I_{11}$ and $I_{12}$ with positive temperature coefficients flowing through the first node X to combine into the first current $I_1$, and further convert at least one of the branch currents $I_{11}$ and $I_{12}$ into the reference voltage Vref to be outputted at the first node X. In the following description, the operational principle of the band-gap reference circuit 110 will be further given in detail.

Continuing to refer to FIG. 1, since the collectors and bases of the junction transistors Q1 and Q2 are all coupled to the ground voltage GND, the voltage Vb of the node B is equal to ($V1+V_{BE2}$) and the voltage Va of the node A is equal to $V_{BE1}$. Moreover, through a virtual-short effect of the operational amplifier 114, the voltage of the first input terminal In1 is equal to the voltage of the second input terminal In2. In other words, the voltage Vb of the node B is equal to the voltage Va of the node A, i.e. Va=Vb.

According to the above discussion, it can be obtained that the voltage drop V1 across the first resistor device R1 is equal to ($V_{BE1}-V_{BE2}=KTIn(n)$), and the current $I_{11}$ flowing by the first resistor device R1 is KTIn(n)/R1, wherein K is a constant, T is the absolute temperature, n is an area ratio of the junction transistors Q2 and Q1, R1 is a resistance value of the first resistor device R1. In other words, the current $I_{11}$ is a PTAT current, having a positive temperature coefficient.

The reference voltage Vref is equal to a sum of a voltage drop across the base and emitter of the junction transistor Q2 and a voltage drop (V1+V2) across the resistor devices R1 and R2. That is, $Vref=V1+V2+V_{BE2}=I_{11}(R1+R2)+V_{BE2}=KTIn(n)(R1+R2)/R1+V_{BE2}$. By suitably selecting the resistance values of the resistor devices R1 and R2, the positive temperature coefficient of the voltage drop KTIn(n)(R1+R2)/R1 of the resistor devices R1 and R2 can compensate the negative temperature coefficient of the voltage drop $V_{BE2}$ across the base and emitter of the junction transistor Q2 so as to generate the reference voltage Vref with a zero temperature coefficient (i.e. temperature independent). Similarly, the voltage drop $V_{BE1}$ of the junction transistor Q1 can be summed with the voltage drop V3 across the resistor device R3 so as to obtain the reference voltage Vref.

On the other hand, the first current $I_1$ is divided at the first node X into the current $I_{11}$ flowing through the first resistor device R1 and the second resistor device R2 and the current $I_{12}$ flowing through the third resistor device R3, i.e. $I_1=I_{11}+I_{12}$. Through a virtual-short effect of the operational amplifier 114, the voltage Va is equal to Vb, and $I_1=I_{11}+I_{12}=KTIn(n)(1+R2/R3)/R1$, wherein R2 and R3 are resistance values of the second resistor device R2 and the third resistor device R3, respectively. In other words, the first current $I_1$ has also a positive temperature coefficient.

To sum up, the band-gap reference circuit 110 can generate the first current $I_1$ with a positive temperature coefficient flowing through the first node X and generate a reference voltage Vref with a zero temperature coefficient to be outputted at the first node X.

In the following description, the detailed structure and operational principle of the voltage-to-current converting circuit 120 will be illustrated. FIG. 1 also shows the detailed circuit diagram of the voltage-to-current converting circuit 120 according to a preferred embodiment. As shown in FIG. 1, the voltage-to-current converting circuit 120 includes a bias current source 122 and an operational amplifier 124 in addition to the common current source 116.

The operational amplifier 124 has a first input terminal In1 (e.g. a positive input terminal +) coupled to the second node A of the band-gap reference circuit 110, a second input terminal In2 (e.g. a negative input terminal −), and an output terminal O2.

The bias current source 122, which can be coupled to the common current source 116 at the first node X and coupled to the second input terminal In2 and output terminal O2 of the operational amplifier 124, is configured for flowing a second current $I_2$ according to the negative-temperature-coefficient voltage Va at the second node A.

In a specific embodiment (as shown in FIG. 1), the bias current source 122, for example, includes a bias transistor M2 and a fourth resistor device R4. The bias transistor M2, for example, can be a n-type metal oxide semiconductor (NMOS) transistor, having a first terminal (i.e. a gate) coupled to the output terminal O2 of the operational amplifier 124, a second terminal (i.e. a drain) coupled to the first node X, and a third terminal (i.e. a source). The resistor device R4 has one end coupled to the third terminal of the bias transistor M2 and the second input terminal In2 of the operational amplifier 124 and the other end coupled to a ground voltage.

Under such a circuit configuration, the bias current source 122 can operate together with the operational amplifier 124 and the common current source 116 to generate the second current $I_2$ based on the negative-temperature-coefficient voltage Va at the second node A. In the following description, the operational principle of the voltage-to-current converting circuit 120 will be illustrated.

Continuing to refer to FIG. 1, the output terminal O2 of the operational amplifier 124 is coupled in feedback to the gate of the bias transistor M2 for controlling the bias transistor M2 to output the second current I2. When the second current I2 flows through the bias transistor M2 and the fourth resistor device R4, a voltage drop Vc(=$I_2$*R4) across the fourth resistor device R4 is generated, wherein R4 is a resistance value of the fourth resistor device R4. At the same time, through a virtual-short effect of the operational amplifier 124, the voltage of the first input terminal In1 is equal to the voltage of the second input terminal In2, and accordingly, the voltage Vc of the node C is equal to the voltage Va of the node A, i.e. Vc=Va=$V_{BE1}$.

According to the above discussion, it can be deducted that the second current $I_2$=$V_{BE1}$/R4. Since the voltage drop $V_{BE1}$ across the base and emitter of the junction transistor Q1 has a negative temperature coefficient, the second current $I_2$ (=$V_{BE1}$/R4) has also a negative temperature coefficient. Consequently, the voltage-to-current converting circuit 120 can convert the voltage Va with a negative temperature coefficient at the node A into the second current I2 with a negative temperature coefficient.

To conclude the above operations, within the reference voltage and reference current generating circuit 100, the band-gap reference circuit 110 is used to generate a temperature-independent reference voltage Vref, and the voltage-to-current converting circuit 120 is used to share a common current source 116 with the band-gap reference circuit 110. Accordingly, the common current source 116 generates not only the PTAT current $I_1$ but also the NTAT (negative proportional to the absolute temperature) current $I_2$. Additionally, through suitable design, the positive temperature coefficient of the first current $I_1$ can be adjusted to be equal to the negative temperature coefficient of the second current $I_2$, such that the first current $I_1$ and the second current $I_2$ are combined into the temperature-independent reference current Iref (=$I_1$+$I_2$).

For example, in the embodiment of FIG. 1, the reference current Iref=$I_1$+$I_2$=KTIn(n)(1+R2/R3)/R1+$V_{BE1}$/R4. By suitably selecting the resistance values of the first to fourth resistor devices R1 to R4, the amount of the first current $I_1$ varying positively with the temperature can compensate the amount of the second current $I_2$ varying negatively with the temperature, so as to generate the reference current Iref with a zero temperature coefficient (i.e. temperature independent).

It is noted that although the feedback transistor M1 and the bias transistor M2 are exemplified for illustration to be MOS transistors in the embodiment of FIG. 1, in other embodiments, the feedback transistor M1 and the bias transistor M2 can also be bipolar junction transistors (BJT).

Furthermore, it is noted that in the PTAT current generating part of the embodiment as shown in FIG. 1, although the two junction transistors Q1 and Q2 are exemplified for illustration to be coupled with the resistor devices R1~R3 so as to generate two branch currents $I_{12}$ and $I_{11}$ with positive temperature coefficients, the PTAT current generating part 112 of the invention is not limited thereto. Various circuit structures can be employed as the PTAT current generating part 112, cooperating with the operational amplifier 114 and the common current source 116 to generate a positive-temperature-coefficient current and a zero-temperature-coefficient reference voltage.

For example, in other embodiments, two or more junction transistors coupled to a suitable number of resistor devices can be used to generate two or more branch currents each having a positive temperature coefficient for combining into the first current $I_1$, and convert at least one of the branch currents into the reference voltage Vref. More specifically, based on a feature that the junction transistors have a negative-temperature-coefficient voltage drop and the conversion feature of several resistor devices to generate a number of positive-temperature-coefficient branch currents and second voltage drops, a zero-temperature-coefficient reference voltage can be obtained, by summing the negative-temperature-coefficient voltage drop of the transistors and the positive-temperature-coefficient voltage drop of the resistor device, and additionally, the positive-temperature-coefficient first current $I_1$ can also be obtained by combining the branch currents.

Or simply speaking, it is possible to employ, within any PTAT current generating circuit which can generate a zero-temperature-coefficient reference voltage by generating a positive-temperature-coefficient current, a relevant portion (such as the circuit portion other than a bias current source and an operational amplifier) as the PTAT current generating part 112.

Besides, it is noted that the common current source 116 and the bias current source 122 are not limited to the detailed circuit structures of FIG. 1. Various current sources can be configured in the band-gap reference circuit 110 and the voltage-to-current converting circuit 120 to supply the required current. Additionally, various structures of bias current sources can be also used to cooperate with the operational amplifier 124 so as to convert a negative-temperature-coefficient voltage into a negative-temperature-coefficient current.

Furthermore, it is noted that the operational amplifiers 114 and 124 can also be replaced with other voltage-equalizing circuits. As long as the voltage Va of the node A is suitably controlled so as to be equal to the voltage Vb of the node B, and the voltage Vc of the node C is controlled so as to be equal to the voltage Va of the node A, the positive-temperature-coefficient current $I_1$ and the negative-temperature-coefficient current $I_2$ can be still generated.

Moreover, although it is exemplified for illustration that the bases and collectors of the junction transistors Q1 and Q2 are grounded, one terminal of the feedback transistor M1 is coupled to the voltage source VDD such that the reference current Iref flows outwards from the common current source 116 to separate into the first current $I_1$ and the second current $I_2$, the invention is not limited thereto. For example, in alternative embodiments, the transistors M1 and M2 can be replaced with NMOS transistors, the junction transistors Q1 and Q2 can be replaced with NPN-type transistors whose bases and collectors can be coupled instead to a high voltage (VDD), and the feedback transistor M1 can be coupled instead to a low voltage (GND). In such alternative embodiments, the reference current Iref is formed by the first current $I_1$ and the second current $I_2$ flowing towards the common current source 116.

In addition, to analogize from the above discussion, a reference voltage and reference current generating circuit can be implemented by just using a PTAT current generating circuit to generate a positive-temperature-coefficient current and thereby generate a zero-temperature-coefficient reference voltage, and additionally drawing out a negative-temperature-coefficient current from a bias current source within the PTAT current generating circuit and supplying it to a voltage-to-current converting circuit.

Simply speaking, as long as a band-gap reference circuit is used to supply a temperature-independent reference voltage, and a common current source is used to generate a negative-temperature-coefficient current to flow through a voltage-to-current converting circuit simultaneously when supplying a positive-temperature-coefficient current required for generating the reference voltage, such that the two currents are combined into a temperature-independent reference current, all possible alternative implementations are not apart from the scope of the invention.

Figure 2:
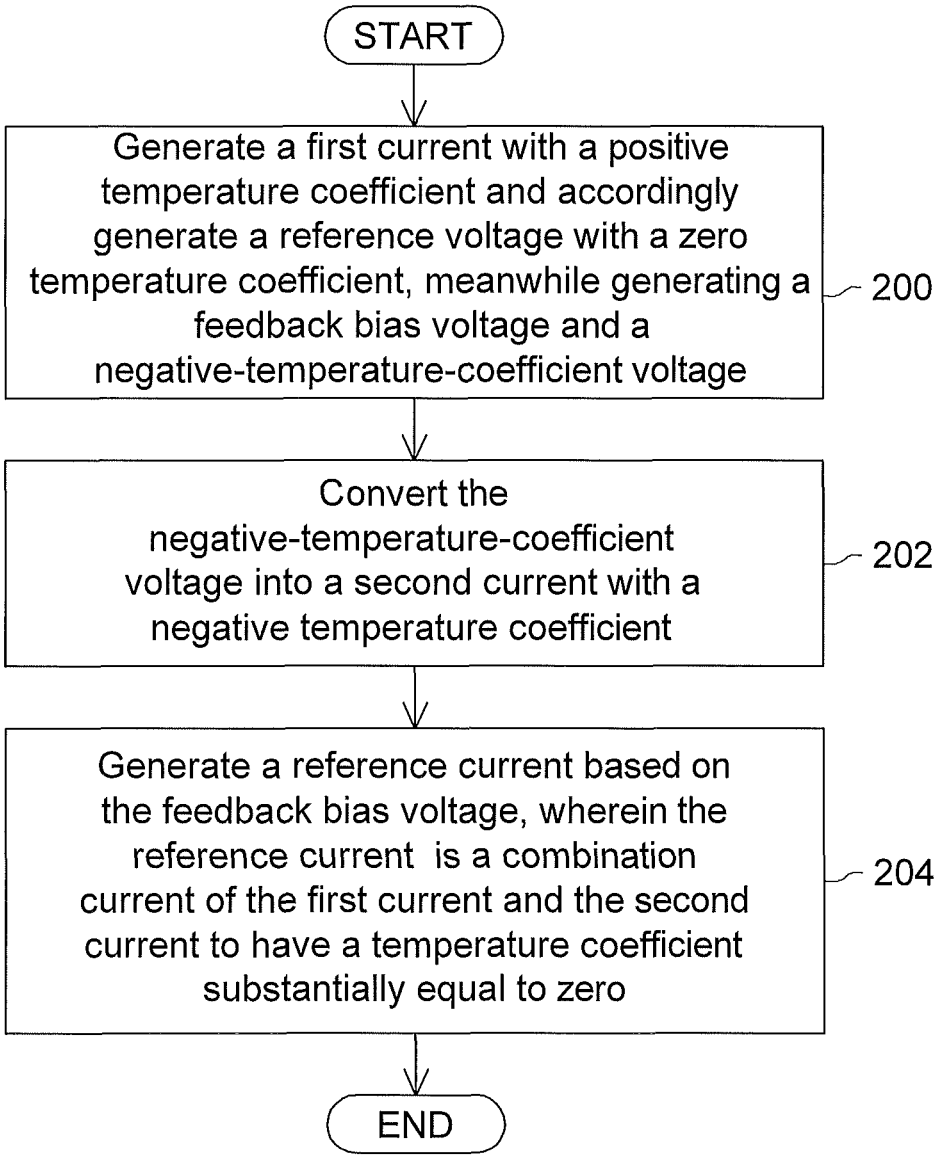
FIG. 2 is a flow chart of a reference voltage and reference current generating method according to a preferred embodiment.

Referring to FIG. 2, a flow chart of a reference voltage and reference current generating method according to a preferred embodiment is shown. First, in step 200, a first current l with a positive temperature coefficient is generated and then a reference voltage Vref with a zero temperature coefficient is generated accordingly. Meanwhile, a feedback bias voltage Vf and a negative-temperature-coefficient voltage Va are also generated. Next, in step 202, the negative-temperature-coefficient voltage Va is converted into a second current $I_2$ with a negative temperature coefficient. Finally, in step 204, based on the feedback bias voltage Vf, a reference current Iref is generated, which is divided into the first current $I_1$ of the step 200 and the second current $I_2$ of the step 202. Consequently, the reference current Iref, as a combination current of the first current $I_1$ and the second current $I_2$, can have a temperature coefficient substantially equal to zero. The relevant details of each step can be referred to the description of the corresponding components in FIG. 1 and thus any unnecessary detail will not be given here.

To conclude, in the above embodiments, a band-gap reference circuit is first used to generate a temperature-independent reference voltage and then a voltage-to-current converting circuit is configured to generate a negative-temperature-coefficient current, wherein the voltage-to-current converting circuit and the band-gap reference circuit share a common current source. In this way, the common current source can further supply a negative-temperature-coefficient current flowing through the voltage-to-current converting circuit in addition to supplying a positive-temperature-coefficient current flowing through the band-gap reference circuit. Consequently, the two branch currents can be combined together to generate the temperature-independent reference current.

As such, it is unnecessary to configure different reference voltage generating circuit and reference current generating circuit or to generate a reference voltage (or reference current) first and then duplicate and convert the reference voltage (or reference current) into a reference current (or reference voltage). Instead, the temperature-independent reference voltage and reference current can be simultaneously generated by just using a single current source. In other words, the generation of reference voltage and reference current can be integrated in conception of circuit design. As a result, compared to the prior-art technology, the above embodiments greatly simplify circuit structure, reduce circuit area and power consumption, and lower down circuit production costs.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A circuit for generating a reference voltage and a reference current, comprising:

a band-gap reference circuit, configured to generate a temperature-independent reference voltage by generating a first current with a positive temperature coefficient; and a voltage-to-current converting circuit, coupled to a node of the band-gap reference circuit and configured to convert a voltage with a negative temperature coefficient at the node into a second current with a negative temperature coefficient;

wherein the band-gap reference circuit and the voltage-to-current converting circuit share a common current source and the common current source has a feedback transistor through which a reference current flows;

wherein the reference current is divided into the first current of the band-gap reference circuit and the second current of the voltage-to-current converting circuit, having a temperature coefficient substantially equal to zero by combining the first current and the second current;

wherein the voltage-to-current converting circuit comprises:

an operational amplifier, having a first input terminal coupled to the node of the band-gap reference circuit, a second input terminal and an output terminal; and a bias current source, coupled to the common current source and to the second input terminal and the output terminal of the operational amplifier, for generating the second current based on the voltage with the negative temperature coefficient at the node.

2. The circuit according to claim 1, wherein the band-gap reference circuit further generates a feedback bias voltage for controlling the common current source to generate the reference current.

3. The circuit according to claim 1, wherein the band-gap reference circuit further comprises:

a proportional-to-absolute-temperature (PTAT) current generating part, coupled to the common current source and configured to generate a plurality of branch currents with positive temperature coefficients for combining into the first current, and convert at least one of the branch currents into the reference voltage; and an operational amplifier, having two input terminals coupled to two nodes of the PTAT current generating part such that voltages of the two nodes are substantially equal, and having an output terminal coupled in feedback to the common current source for controlling the common current source to output the reference current.

4. The circuit according to claim 3, wherein the PTAT current generating part comprises:

a plurality of junction transistors, for generating a plurality of first voltage drops having negative temperature coefficients; and a plurality of resistor devices, coupled to the junction transistors for generating the branch currents and a plurality of second voltage drops having positive temperature coefficients;

wherein at least one of the first voltage drops and at least one of the second voltage drops are combined into the reference voltage.

5. The circuit according to claim 4, wherein the junction transistors comprise a first junction transistor and a second junction transistor, each having a first terminal, a second terminal and a third terminal, the second terminals of the first and the second junction transistors are coupled to each other, and the resistor devices comprise:

a first resistor device, having one end coupled to the first terminal of the second junction transistor;

a second resistor device, having one end coupled to the other end of the first resistor device and the other end coupled to the common current source; and a third resistor device, having one end coupled to the first terminal of the first junction transistor and the other end coupled to the common current source.

6. The circuit according to claim 3, wherein the feedback transistor of the common current source is coupled to a voltage source, the PTAT current generating part and the output terminal of the operational amplifier of the band-gap reference circuit.

7. The circuit according to claim 1, wherein the bias current source comprises:

a bias transistor, having a first terminal coupled to the operational amplifier, a second terminal coupled to the common current source and a third terminal; and a resistor device, having one end coupled to the third terminal of the bias transistor and the second input terminal of the operational amplifier.

8. A circuit for generating a reference voltage and a reference current, comprising:

a band-gap reference circuit, configured to generate a first current with a positive temperature coefficient flowing through a first node of the bank-gap reference circuit, thereby generating a temperature-independent reference voltage to be outputted at the first node; and a voltage-to-current converting circuit, coupled to a second node of the band-gap reference circuit and configured to convert a voltage with a negative temperature coefficient at the second node into a second current with a negative temperature coefficient flowing through the first node;

wherein the band-gap reference circuit and the voltage-to-current converting circuit share a common current source coupled to the first node for outputting a reference current;

wherein the reference current is divided into the first current of the band-gap reference circuit and the second current of the voltage-to-current converting circuit at the first node, having a temperature coefficient substantially equal to zero by combining the first current and the second current;

wherein the voltage-to-current converting circuit comprises:

an operational amplifier, having a first input terminal coupled to the first node of the band-gap reference circuit, a second input terminal and an output terminal; and a bias current source, coupled to the common current source and the second input terminal and to the output terminal of the operational amplifier, for generating the second current based on the voltage with the negative temperature coefficient at the first node.

9. The circuit according to claim 8, wherein the band-gap reference circuit further generates a feedback bias voltage for controlling the common current source to generate the reference current.

10. A circuit for generating reference voltage and reference current, comprising:

a band-gap reference circuit, for outputting a temperature-independent reference voltage, the band-gap reference circuit comprising:

a proportional-to-absolute-temperature (PTAT) current generating part, comprising:

a first junction transistor and a second junction transistor coupled to each other; and a first resistor device, a second resistor device and a third resistor device, respectively coupled between the second junction transistor and the second resistor device, between the first resistor device and a first node, and between the first junction transistor and the first node; and a first operational amplifier, having a first input terminal coupled between the first resistor device and the second resistor device, a second input terminal coupled between the third resistor device and the first junction transistor, and an output terminal; and a voltage-to-current converting circuit, comprising:

a second operational amplifier, having a first input terminal coupled between the first junction transistor and the third resistor device, a second input terminal and an output terminal; and a bias current source, comprising a bias transistor, the bias transistor having a first terminal coupled to the output terminal of the second operational amplifier, a second terminal coupled to the first node and a third terminal; and a fourth resistor device, having one end coupled to the third terminal of the bias transistor and the second input terminal of the second operational amplifier;

wherein the band-gap reference circuit and the voltage-to-current converting circuit share a common current source, the common current source comprising a feedback transistor coupled to a voltage source, the first node and the output terminal of the first operational amplifier for outputting a temperature-independent reference current.

* * * * *